US006862014B2

(12) United States Patent
Ohtani et al.

(10) Patent No.: US 6,862,014 B2
(45) Date of Patent: Mar. 1, 2005

(54) DISPLAY DRIVING APPARATUS AND DRIVING CONTROL METHOD

(75) Inventors: Tomohiko Ohtani, Tachikawa (JP); Tomomi Kamio, Hachioji (JP)

(73) Assignee: Casio Computer Co., Ltd., Tokyo (JP)

( * ) Notice: Subject to any disclaimer, the term of this patent is extended or adjusted under 35 U.S.C. 154(b) by 326 days.

(21) Appl. No.: 10/261,956

(22) Filed: Oct. 1, 2002

(65) Prior Publication Data

US 2003/0071773 A1 Apr. 17, 2003

(30) Foreign Application Priority Data

Oct. 5, 2001 (JP) ..... 2001-310483

(51) Int. Cl.[7] ..... G09G 3/36

(52) U.S. Cl. ..... 345/96; 345/209; 345/204; 345/89; 345/690; 345/92

(58) Field of Search ..... 345/87–104, 204, 345/690, 208–210

(56) References Cited

U.S. PATENT DOCUMENTS 5,093,655 A * 3/1992 Tanioka et al. ..... 345/96
5,402,142 A * 3/1995 Okada et al. ..... 345/95
2003/0151572 A1 * 8/2003 Kumada et al. ..... 345/87
2003/0189537 A1 * 10/2003 Yun ..... 345/87
2003/0214470 A1 * 11/2003 Sun ..... 345/87

FOREIGN PATENT DOCUMENTS

EP 0558059 * 9/1993 ..... G09G/3/36
JP 11-281959 10/1999
JP 2000-267618 * 9/2000 ..... G09G/3/36

* cited by examiner

*Primary Examiner*—Lun-yi Lao
(74) *Attorney, Agent, or Firm*—Frishauf, Holtz, Goodman & Chick, P.C.

(57) ABSTRACT

A display driving apparatus includes common electrode reverse section for reversing a potential of a common electrode of an active matrix liquid crystal display panel for each predetermined period, and gradation reference voltage setting section for setting minimum and maximum gradation reference voltages based on a contrast set value and correction voltage set value, every time the potential of the common electrode is reversed and for setting one of fluctuation center voltages of the gradation reference voltages, by which a smaller voltage is applied to liquid crystal display pixels, such that one voltage is higher than the other by a voltage corresponding to the correction voltage set value.

17 Claims, 9 Drawing Sheets

PRIOR ART

DISPLAY DRIVING APPARATUS AND DRIVING CONTROL METHOD

CROSS-REFERENCE TO RELATED APPLICATIONS

This application is based upon and claims the benefit of priority from the prior Japanese Patent Application No. 2001-310483, filed Oct. 5, 2001, the entire contents of which are incorporated herein by reference.

BACKGROUND OF THE INVENTION

1. Field of the Invention

The present invention relates to a display driving apparatus which drives a liquid crystal display panel and a display apparatus using the display driving apparatus, particularly to a display driving apparatus which drives an active matrix liquid crystal display panel.

2. Description of the Related Art

In recent years, display apparatuses having liquid crystal display panels have become increasingly widespread, in such products as digital videos and still cameras, portable phones, and personal digital assistants (PDAs), to display characters and/or images. Liquid crystal display panels are also used as display apparatuses for information terminals, such as computer displays and video monitors, replacing the conventional cathode ray tubes (CRTs).

As the liquid crystal display panel for the above-described use, an active matrix liquid crystal display panel (hereinafter referred to as a TFT-LCD) has been frequently used in which a relatively high image quality is obtained and a thin film transistor (TFT) is used as a switching device.

A major constituent of a conventional display apparatus in which a TFT-LCD is used will next be described with reference to the drawings.

The TFT-LCD is a display in which a TFT for selectively applying a voltage to each liquid crystal display pixel and the liquid crystal display pixels are arranged in a matrix form on a glass substrate.

FIG. 11 shows an equivalent circuit of a liquid crystal display pixel 100 in the TFT-LCD. As shown in FIG. 11, the liquid crystal display pixel 100 includes: a TFT which is disposed in each intersection of a gate line GL extended in a row direction and a data line DL extended in a column direction and in which a gate electrode G is connected to the gate line GL and a source electrode S is connected to the data line DL; a pixel electrode connected to a drain electrode D of the TFT; a liquid crystal display pixel capacitance $C_{LC}$ including a liquid crystal held by an opposed electrode 1 disposed opposite to the pixel electrode; and an auxiliary capacitance $C_S$ including an insulating film held between the pixel electrode and auxiliary capacitance electrode 2. In the TFT-LCD, a plurality of liquid crystal display pixels 100 are arranged/constituted in the matrix form. Moreover, a common electrode VCOM is connected in common to the opposed electrode 1 and auxiliary capacitance electrode 2 of each liquid crystal display pixel 100.

FIGS. 12A to 12D show one example of a timing chart of a signal waveform for driving the TFT-LCD.

In FIG. 12A, $V_G$ is a waveform showing a potential of the gate line GL, and is a scanning signal. In FIG. 12B, $V_S$ is a waveform showing a potential of the data line DL, and is a voltage corresponding to a display data signal, and its center voltage is set to $V_S$DC. These signals $V_G$, $V_S$ are applied to the gate electrode G and source electrode S of each TFT.

In FIG. 12C, $V_{COM}$ is a waveform showing a potential of the opposed electrode 1 and auxiliary capacitance electrode 2 connected to the common electrode $V_{COM}$, and its center voltage is set to $V_{COM}$DC. When a direct-current voltage continues to be applied to the liquid crystal, the liquid crystal is deteriorated. Therefore, for $V_S$ and $V_{COM}$, for example, polarity is reversed, and each frame is driven in reverse.

FIG. 12D shows a change of a voltage $V_{LC}$ applied to the liquid crystal capacitance $C_{LC}$ of the liquid crystal display pixel 100.

As shown in FIG. 12D, when the potential of the gate line GL reaches a "Hi" level in a time T1 of a first frame, and thus the TFT turns "on", the potential of the pixel electrode becomes equal to the potential $V_S$ of the data line DL. Thereby, a voltage of a difference between the potential applied to the common electrode $V_{COM}$ and the potential $V_S$ of the data line DL is applied to the liquid crystal capacitance $C_{LC}$.

In time T2, the potential of the gate line GL is at a "Low" level, and the TFT turns "off". Thereby, a charge applied to the liquid crystal capacitance $C_{LC}$ is held in the time T1. However, a potential change in a moment in which the potential of the gate line GL is brought into the "Low" level acts in a direction in which the potential of the pixel electrode is lowered via a gate-drain parasitic capacitance $C_{GD}$ of the TFT, and the voltage $V_{LC}$ applied to the liquid crystal capacitance $C_{LC}$ drops by a field through voltage ΔV described later.

In a second frame, the potential $V_S$ of the data line DL and the potential $V_{COM}$ of the common electrode VCOM are reversed, the potential of the gate line GL reaches the "Hi" level in time T3, and thereby the TFT turns "on". Then, the potential of the pixel electrode becomes equal to the potential $V_S$ of the data line DL, and the voltage of the difference between the voltage applied to the common electrode VCOM and the potential $V_S$ of the data line DL is applied to the liquid crystal capacitance $C_{LC}$.

Similarly as the time T2, in time T4, the potential of the gate line GL is brought into the "Low" level, thereby the TFT turns "off", and the electric charges charged into the liquid crystal capacitance $C_{LC}$ are held in the time T3. Moreover, the potential change at the moment in which the potential of the gate line GL is brought into the "Low" level exerts an influence via the gate-drain parasitic capacitance $C_{GD}$ of the TFT, and the voltage $V_{LC}$ applied to the liquid crystal capacitance $C_{LC}$ drops by the field through voltage ΔV. Thereafter, the TFT turns "off" and thereby the electric charges charged into the liquid crystal capacitance $C_{LC}$ are held.

The field through voltage ΔV is represented as follows.

$$\Delta V=\Delta V_G\times(C_{GD}/(C_{GD}+C_{LC}+C_S)) \quad (1)$$

Here, $\Delta V_G$ denotes a change amount of the potential of the gate line, $C_{GD}$ denotes a gate-drain parasitic capacitance, $C_{LC}$ denotes a liquid crystal capacitance of a pixel electrode portion, and $C_S$ denotes an auxiliary capacitance.

As shown in FIG. 12D, when a fluctuation of the field through voltage ΔV is generated in the voltage $V_{LC}$ applied to the liquid crystal capacitance $C_{LC}$, the waveform of the voltage $V_{LC}$ becomes a positive/negative asymmetric waveform with respect to the voltage $V_{COM}$. A difference is generated in positive and negative charge amounts held by the liquid crystal capacitance $C_{LC}$, and thus a direct-current voltage component is generated.

Thereby, flicker (blinking) is generated. Moreover, when the direct-current voltage is applied to the liquid crystal, seizing occurs, and display quality is deteriorated.

Further, when the direct-current voltage is applied to the liquid crystal, the liquid crystal is deteriorated, and reliability of the liquid crystal drops.

To solve the above-described problem, for example, the center voltage $V_S$DC of the potential $V_S$ of the data line DL has heretofore been set to be higher by about ΔV. The positive and negative charge amounts generated by the voltage $V_{LC}$ applied to the liquid crystal capacitance $C_{LC}$ and held by the liquid crystal capacitance $C_{LC}$ are adjusted so as to be substantially the same. Thereby, the direct-current voltage component is reduced, the generation of the flicker is suppressed, and the occurrence of seizing and the deterioration of the liquid crystal are inhibited.

However, the liquid crystal capacitance $C_{LC}$ is not constant with respect to the voltage $V_{LC}$ applied to the liquid crystal. FIG. 13 shows one example of change characteristics of a dielectric constant ∈r of the liquid crystal with respect to the applied voltage $V_{LC}$. As shown in FIG. 13, in general, the dielectric constant ∈r of the liquid crystal has characteristics that the constant increases with an increase of the applied voltage $V_{LC}$.

Here, the liquid crystal capacitance $C_{LC}$ is represented as follows.

$$C_{LC}=\in 0^*\in r^*S/d$$

Therefore, the value of the liquid crystal capacitance $C_{LC}$ also changes in accordance with the applied voltage $V_{LC}$, and increases with the increase of the applied voltage $V_{LC}$. Here, S denotes a pixel electrode area, d denotes a cell gap, and ∈0* denotes a vacuum permittivity.

Here, since the voltage $V_{LC}$ applied to the liquid crystal is a voltage based on the potential $V_S$ of the data line DL, and the potential $V_S$ of the data line DL is a voltage corresponding to the display data signal, the voltage $V_{LC}$ is not constant, and changes in accordance with the display data signal.

That is, since the liquid crystal capacitance $C_{LC}$ changes in accordance with the applied voltage $V_{LC}$, the field through voltage ΔV also changes in accordance with the applied voltage $V_{LC}$ as represented by the equation (1). Here, a change amount of ΔV by the applied voltage $V_{LC}$ is denoted by ΔΔV.

Therefore, the center voltage $V_S$DC of the data line DL is adjusted in accordance with the state of the applied voltage $V_{LC}$ having a certain value (e.g., maximum voltage). Thereby, in this state, it is considered that the positive and negative charge amounts generated by the voltage $V_{LC}$ and held thereby are adjusted so as to be substantially the same, and set so as to eliminate the direct-current voltage component. However, as described above, the applied voltage $V_{LC}$ is the voltage corresponding to the display data signal, and always changes. Accordingly, the field through voltage ΔV also changes. Therefore, when the applied voltage $V_{LC}$ changes, the positive and negative charge amounts held by the liquid crystal capacitance $C_{LC}$ change. Therefore, the positive and negative charge amounts held by the liquid crystal capacitance $C_{LC}$ cannot be adjusted so as to be constantly the same.

To solve this problem, the auxiliary capacitance $C_S$ has heretofore been set to be relatively large so as to reduce the magnitude of the field through voltage ΔV, so that the influence of the change of the liquid crystal capacitance $C_{LC}$ is reduced.

However, to increase the auxiliary capacitance $C_S$, an area of the electrode forming the capacitance $C_S$ has to be increased, and thereby an open area ratio drops. Therefore, the display quality is deteriorated, or a luminance of a backlight has to be increased. This causes a problem that power consumption increases.

Furthermore, in recent years, to reduce the apparatus driven by a battery or reduce the power consumption, a driving voltage has been lowered. This increases the use of a low-voltage liquid crystal which operates at a low voltage. In this case, since the voltage applied to the liquid crystal drops, the liquid crystal capacitance decreases, and the field through voltage ΔV tends to be further large. Therefore, the influence of the change of the field through voltage ΔV in accordance with the applied voltage $V_{LC}$ increases, and the flicker and seizing increase. This raises a problem that the display quality is greatly deteriorated.

BRIEF SUMMARY OF THE INVENTION

The present invention has advantages, in a display driving apparatus which drives an active matrix liquid crystal display panel and a display apparatus using the display driving apparatus, such that a voltage level applied to a display pixel is corrected in accordance with a change of a field through voltage of the display pixel so that occurrence of flicker or seizing is inhibited without increasing an auxiliary capacitance, a high-quality display is achieved, and reliability of a liquid crystal can be enhanced.

To obtain the above-described advantages, a display driving apparatus and a display apparatus using the display driving apparatus according to the present invention comprise: an active matrix liquid crystal display panel including a plurality of pixel electrodes arranged in a matrix form, a common electrode disposed opposite to the pixel electrodes, and a plurality of liquid crystal display pixels including liquid crystals held between the pixel electrodes and common electrode; a common electrode reverse section for reversing a potential of the common electrode of the liquid crystal display panel for each predetermined period; and a gradation reference voltage setting section for setting minimum and maximum gradation reference voltages based on a contrast set value and correction voltage set value, every time the common electrode reverse sectons reverses the common electrode potential and for setting one of fluctuation center voltages of the minimum and maximum gradation reference voltages for each reverse of the common electrode potential, by which a smaller voltage is applied to the liquid crystal display pixels, such that the one voltage is higher than the other voltage by a voltage corresponding to the correction voltage set value.

The voltage corresponding to the correction voltage set value in the gradation reference voltage setting section has a voltage value of a difference between a value of a field through voltage in the liquid crystal display pixels obtained when one of the minimum and maximum gradation reference voltages is applied to the liquid crystal display pixels in the active matrix liquid crystal display panel, and a value of a field through voltage in the liquid crystal display pixels obtained when the other voltage is applied.

The gradation reference voltage setting section includes: reference voltage selection section including γ reference voltage generation section for generating voltages of a plurality of stages, first voltage selection section for selecting and outputting a first voltage of a stage corresponding to a first value based on the contrast set value and correction voltage set value from the voltages of the plurality of stages generated by the γ reference voltage generation section, and second voltage selection section for selecting and outputting a second voltage of a stage corresponding to a value obtained by subtracting a second value based on the contrast set value and correction voltage set value from a maximum value of the number of stages from the voltages of the plurality of stages generated by the γ reference voltage generation section, every time the potential of the common electrode is reversed; and reference voltage output section for alternately outputting the first and second voltages outputted from the reference voltage selection section as the minimum and maximum gradation reference voltages, every time the potential of the common electrode is reversed.

The first and second values based on the contrast set value and correction voltage set value in the first and second voltage selection section are any one of a value by the contrast set value and a value obtained by subtracting a value by the correction voltage set value from the value by the contrast set value, or a maximum value of the number of stages in the γ reference voltage generation section and the value by the contrast set value or the value obtained by subtracting the value by the correction voltage set value from the value by the contrast set value. Every time the common electrode potential is reversed, the first and second values are alternately set. Moreover, the correspondence of the first and second values with respect to the polarity reverse of the common electrode potential is reversed depending on whether the active matrix liquid crystal display panel is of a normally white system or normally black system.

To obtain the above-described advantages, according to the present invention, there is provided a driving control method of a display driving apparatus comprising: reversing/driving a potential of a common electrode of an active matrix liquid crystal display panel for each predetermined period; setting minimum and maximum gradation reference voltages based on a contrast set value and correction voltage set value, every time the common electrode potential is reversed; and setting one of fluctuation center voltages of the respective gradation reference voltages for each reverse of the common electrode potential, by which a smaller voltage is applied to liquid crystal display pixels, such that the one voltage is higher than the other voltage by a voltage corresponding to the correction voltage set value. The voltage corresponding to the correction voltage set value has a voltage value of a difference between a value of a field through voltage in the liquid crystal display pixels obtained when one of the minimum and maximum gradation reference voltages is applied to the liquid crystal display pixels in the active matrix liquid crystal display panel, and a value of a field through voltage in the liquid crystal display pixel obtained when the other voltage is applied.

A setting method of the minimum and maximum gradation reference voltages based on the contrast set value and correction voltage set value includes: generating gradation voltages of a plurality of stages; selecting and outputting a first voltage of a stage corresponding to a first value based on the contrast set value and correction voltage set value, and a second voltage of a stage corresponding to a value obtained by subtracting a second value based on the contrast set value and correction voltage set value from a maximum value of the number of stages from gradation voltages of the plurality of stages, every time the potential of the common electrode is reversed; and alternately setting the first and second voltages as the minimum and maximum gradation reference voltages, every time the potential of the common electrode is reversed.

The first and second values based on the contrast set value and correction voltage set value are any one of the value by the contrast set value and the value obtained by subtracting the value by the correction voltage set value from the value by the contrast set value, or the maximum value of the stage number of the gradation voltages and the value obtained by subtracting the value by the correction voltage set value from the value by the contrast set value, or the value by the contrast set value and the maximum value of the number of stages of the gradation voltages. Every time the common electrode potential is reversed, the first and second values are alternately set. Moreover, the correspondence of the first and second values for each polarity reverse of the common electrode potential is reversed and set depending on whether the active matrix liquid crystal display panel to be driven is of a normally white or black system.

Additional advantages of the invention will be set forth in the description which follows, and in part will be obvious from the description, or may be learned by practice of the invention. The advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
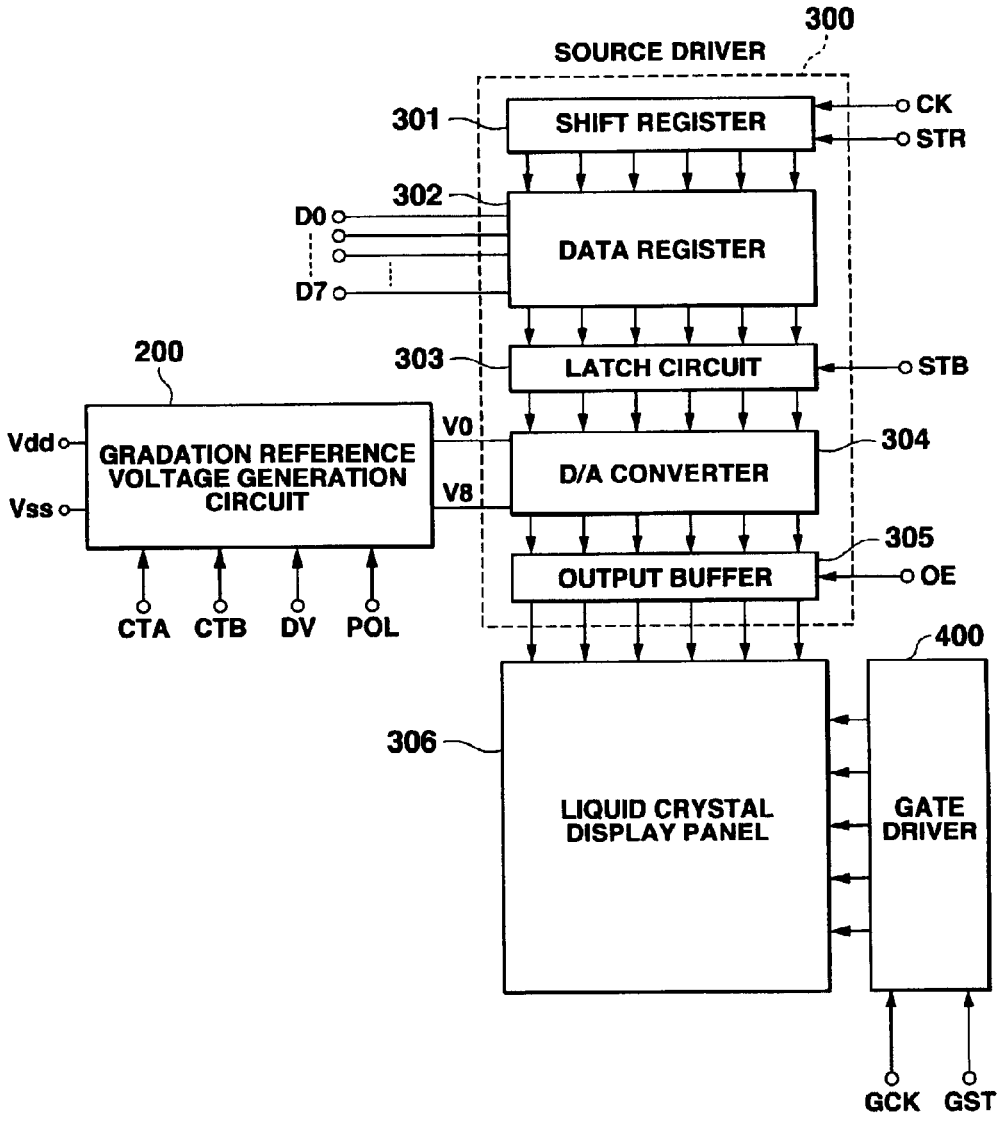
FIG. 1 is a block diagram showing a part of a display apparatus to which a display driving apparatus is applied according to the present invention.

A display driving apparatus, display apparatus using the display driving apparatus, and a driving control method according to the present invention will be described hereinafter in detail based on embodiments shown in the drawings.

<First Embodiment>

A first embodiment of a display driving apparatus according to the present invention will first be described with reference to the drawings.

FIG. 1 is a block diagram showing a part of a display apparatus to which the display driving apparatus of the present invention is applied.

As shown in FIG. 1, the liquid crystal display apparatus includes a gradation reference voltage generation circuit 200, source driver 300, gate driver 400, and liquid crystal display panel 306.

Figure 11:
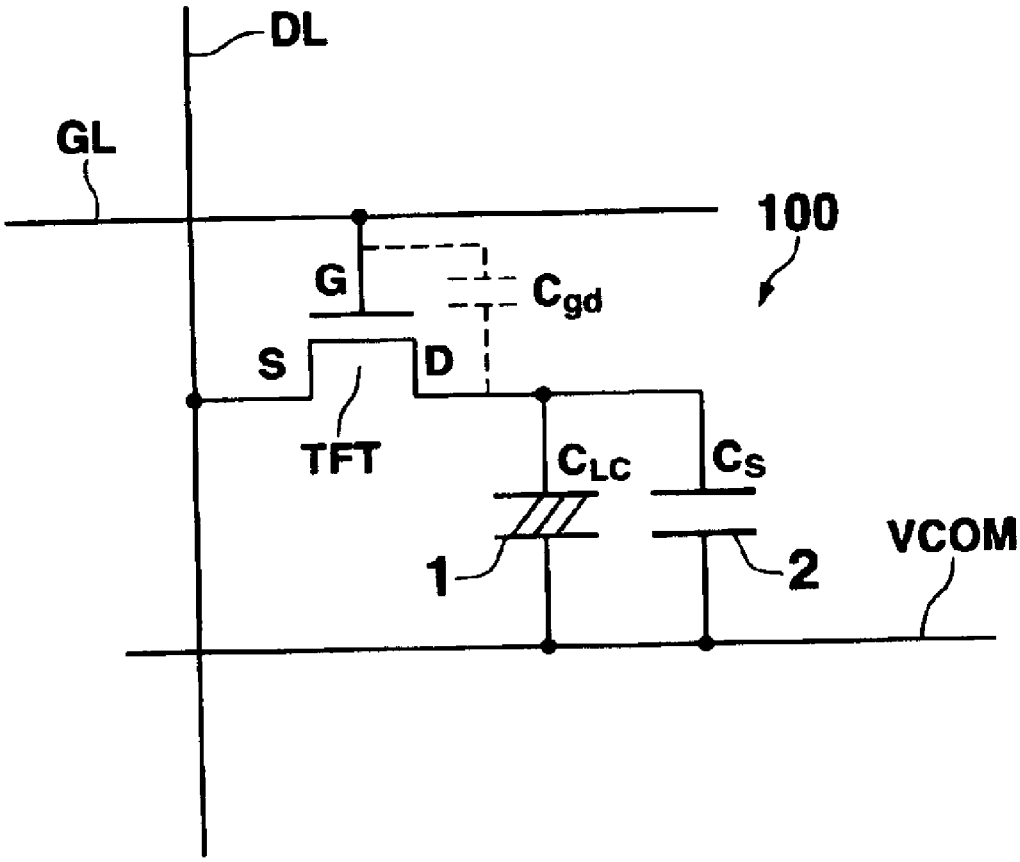
PRIOR ART FIG.11
FIG. 11 is an equivalent circuit diagram of liquid crystal display pixels in a TFT-LCD.
Figure 12:
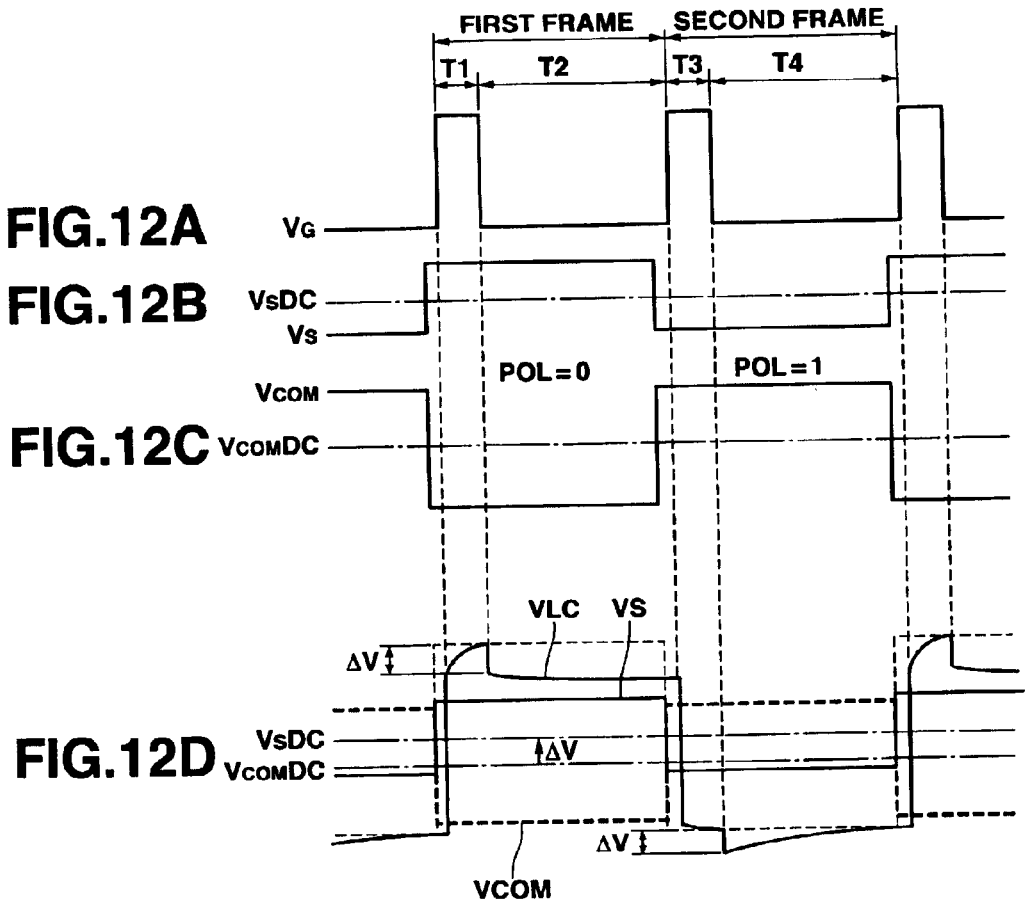
FIGS. 12A to 12D are timing charts of signal waveforms for driving the TFT-LCD.
Figure 13:
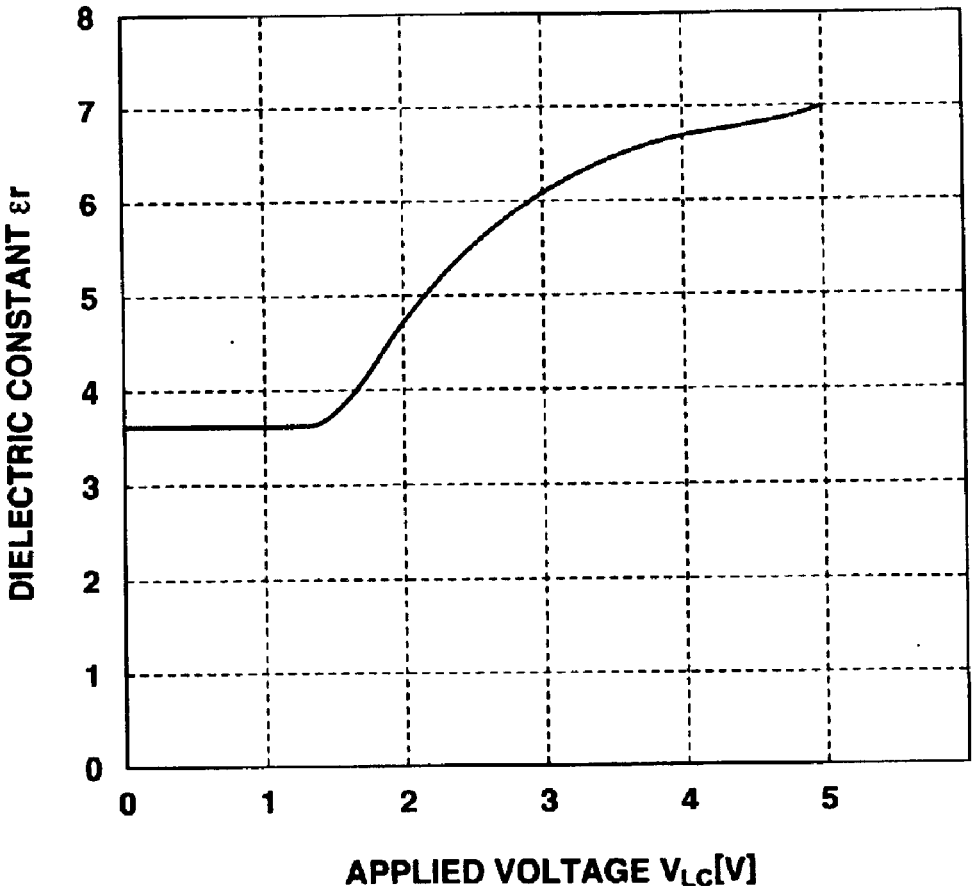
FIG. 13 is a diagram showing one example of change characteristics of a dielectric constant of a liquid crystal with respect to an applied voltage.

The liquid crystal display panel 306 is an active matrix TFT-LCD similar to a conventional panel. Although not shown, the panel includes a plurality of gate lines GL extended in a row direction, and a plurality of data lines DL extended in a column direction. Moreover, a liquid crystal display pixel similar to the liquid crystal display pixel 100 shown in FIG. 11 is disposed in each intersection of the gate line GL and data line DL.

The source driver 300 includes a shift register 301, data register 302, latch circuit 303, D/A converter 304, and output buffer 305. A clock signal CK and shift start signal STR are applied to the shift register 301, and the applied shift start signal STR is successively shifted/operated by the clock signal CK.

The data register 302 includes a plurality of register circuits. For example, display data D0 to D7 including 8-bits digital data is supplied to the circuits, display signals are successively taken at timings of control signals supplied from the shift register 301, and the signals are outputted to the latch circuit 303.

The latch circuit 303 includes a plurality of data holding circuits. When a latch operation control signal STB is applied, the display data taken by the data register 302 is held by the latch circuit 303, and outputted to the D/A converter 304.

To the D/A converter 304, the gradation reference voltage generation circuit 200 applies gradation reference voltages (minimum gradation voltage V0, maximum gradation voltage V8). Based on the applied voltages, voltage for gradations are generated. The converter includes a plurality of D/A conversion circuits, decodes the display data including the digital data supplied from the latch circuit 303, converts the data to gradation voltage values corresponding to display data values, and outputs the values to the output buffer 305.

To the gradation reference voltage generation circuit 200, as described later in detail, predetermined voltages Vdd, Vss are supplied, and a polarity reverse control signal POL, correction signal DV, and contrast setting signals CTA, CTB are applied as the control signals. The circuit 200 appropriately generates the gradation reference voltage based on these control signals.

To the output buffer 305, the display data signal converted to the gradation voltage by the D/A converter 304 is supplied, and an enable signal OE is applied. Then, the buffer supplies the signals to data lines DL of the liquid crystal display panel 306.

Although not detailed, the gate driver 400 includes a shift register and output buffer circuit. A gate clock signal GCK and gate start signal GST are applied to the driver. The gate start signal GST is successively shifted/operated by the gate clock signal GCK, and a scanning signal generated in this manner is successively supplied to each gate line GL of the liquid crystal display panel 306. Thereby, the TFTs connected to each gate line successively turn ON, the display data signal supplied to each data line DL from the output buffer 305 of the source driver 300 is supplied to the liquid crystal display pixel, and an image display operation is performed.

Various control signals applied to the source driver 300 and gate driver 400 are supplied from a controller circuit (not shown).

In the present embodiment, the above-described constitution of the liquid crystal display apparatus is characterized in a setting method of the gradation reference voltage supplied to the D/A converter 304 as a reference voltage for use in determining the gradation voltage corresponding to the gradation of the display data signal supplied to each data line DL of the liquid crystal display panel 306. The constitution is characterized particularly in a constitution of the gradation reference voltage generation circuit 200 for use in setting the gradation reference voltage.

Figure 2:
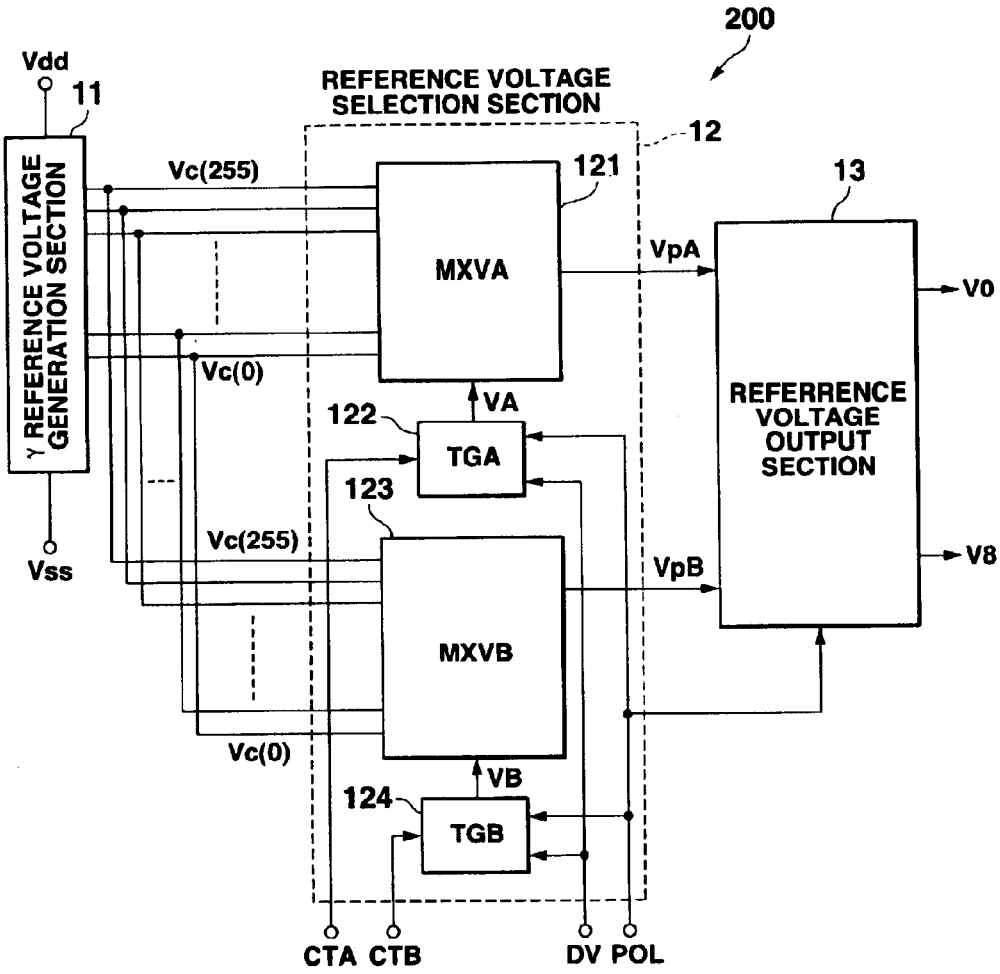
FIG. 2 is a block diagram showing a constitution of a gradation reference voltage generation circuit according to the present invention.

FIG. 2 is a block diagram showing a constitution of the gradation reference voltage generation circuit 200 according to the present invention.

As shown in FIG. 2, the gradation reference voltage generation circuit 200 includes a γ reference voltage generation section 11, reference voltage selection section 12, and reference voltage output section 13.

To the γ reference voltage generation section 11, the predetermined voltages Vdd, Vss (Vdd is a power voltage on a high voltage side, Vss is a power voltage on a low voltage side) are supplied from the outside. The section 11 divides the voltages Vdd to Vss, for example, into 256 stages, generates reference voltages of 256 stages including Vc(0) to Vc(255), and outputs the voltages to the reference voltage selection section 12.

Figure 3:
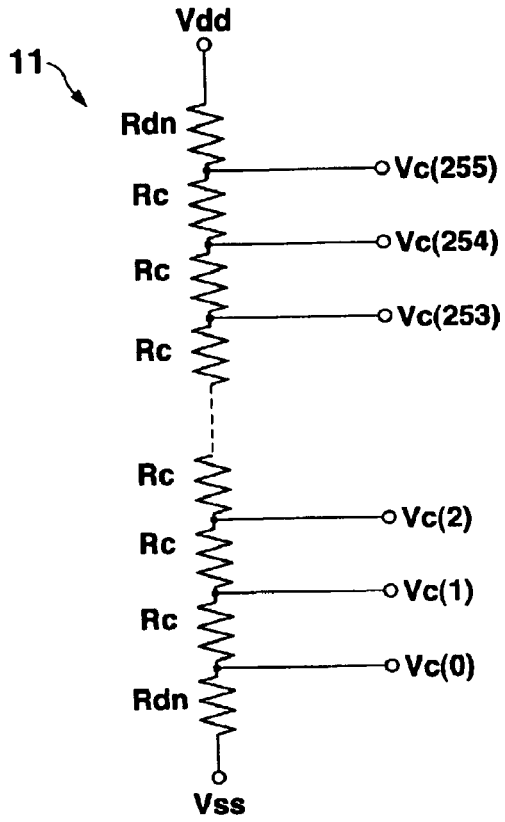
FIG. 3 is a circuit diagram showing one example of a concrete constitution of a γ reference voltage generation section in the gradation reference voltage generation circuit according to the present invention.

One example of a concrete circuit constitution of the γ reference voltage generation section 11 is shown in FIG. 3. The section 11 includes a plurality of resistances Rdn and Rc connected in series between input terminals of the supplied voltages Vdd and Vss, divides the voltages Vss to Vdd by these resistances, and generates and outputs the voltages Vc(0) to Vc(255).

The reference voltage selection section 12 includes a first voltage selection section including an MXVA 121 and TGA 122, and a second voltage selection section including an MXVB 123 and TGB 124. The MXVA 121 and MXVB 123 select corresponding voltages from the reference voltages Vc(0) to Vc(255) supplied from the γ reference voltage generation section 11 in accordance with control signal values inputted from the TGA 122, TGB 124.

As the control signals, CTA[7:0], DV[7:0] and POL are inputted to the TGA 122, and CTB[7:0], DV[7:0], and POL are inputted into the TGB 124.

Here, CTA[7:0] and CTB[7:0] (hereinafter referred to as "CTA", "CTB") are contrast setting signals for setting contrast values of a display image, each constituted of eight bits, and represented in the form of [7:0] indicating eight bits. The number of bits is not limited to eight, and another bit number may also be used.

DV[7:0] is a correction signal for setting a liquid crystal display mode and ΔΔV correction voltage value, similarly constituted of eight bits, and represented in the form of [7:0]. This is not limited to eight bits, and another bit number may also be used.

Here, the most significant bit DV[7] of DV[7:0] is used to indicate the liquid crystal display mode as follows. The liquid crystal display mode includes a normally white system (hereinafter referred to as the "NW system") and normally black system (hereinafter referred to as the "NB" system). These are set by way of arrangement of polarization plates. In the NW system, when the voltage is not applied to the liquid crystal device, white display is performed. When the voltage is applied, transmittance drops, and black display is performed. The NB system is opposite. In accordance with each system, DV[7] is set to "0" in the NW system, and DV[7] is set to "1" in the NB system.

Seven bits DV[6:0] excluding the most significant bit are used as the ΔΔV correction voltage setting signal as follows. This DV[6:0] is set to a value corresponding to a voltage value ΔΔV obtained by subtracting the value of the field through voltage ΔV of the liquid crystal display pixel of a time at which the minimum gradation reference voltage V0 is applied to the liquid crystal display pixel from the value of the field through voltage ΔV of the liquid crystal display pixel of a time at which the maximum gradation reference voltage V8 generated by the gradation reference voltage generation circuit 200 is applied to the liquid crystal display pixel of the liquid crystal display panel 306.

That is, the MXVA 121 and MXVB 123 are constituted to select the voltages of the stages corresponding to the control values inputted from the TGA 122 and TGB 124 from the voltages of the plurality of stages supplied from the γ reference voltage generation section 11. Therefore, the value of DV[6:0] is set such that the voltage selected in accordance with the value of the correction voltage setting signal by DV[6:0] indicates the voltage value of ΔΔV. This aspect will be described later in detail.

The above-described POL is a polarity reverse control signal for controlling the polarity reverse of the common electrode potential $V_{COM}$. When POL indicates "1", $V_{COM}$ reaches the "Hi" level. When POL is "0", $V_{COM}$ indicates the "Low" level.

The TGA 122 and TGB 124 output VA and VB as control values for selecting the voltage as the gradation reference voltage from the voltages of the plurality of stages supplied from the γ reference voltage generation section 11 to the MXVA 121 and MXVB 123 based on the control signals such as the contrast setting signals CTA, CTB, correction signal DV, and polarity reverse control signal POL. This will be described later in detail.

Additionally, the control values VA, VB are set within a range of the gradation number of the reference voltage outputted by the γ reference voltage generation section 11. For example, since the gradation number of the reference voltage is 256 in FIG. 1, the control values VA, VB are set in a range of 0 to 255.

The MXVA 121 selects the voltage of the stage corresponding to the control value VA from the reference voltages of the plurality of stages inputted from the γ reference voltage generation section 11 in accordance with the control value VA, and outputs voltage VpA. That is, VpA=Vc(VA).

The MXVB 123 selects the voltage of the stage corresponding to the value obtained by subtracting the control value VB from the maximum value of the stage number from the reference voltages of the plurality of stages inputted from the γ reference voltage generation section 11 in accordance with the control value VB, and outputs voltage VpB. That is, VpB=Vc(255−VB).

The reference voltage output section 13 includes a buffer circuit and a plurality of switches. The polarity reverse control signal POL is supplied to the section 13. Every time POL is reversed, voltages VpA, VpB inputted from the reference voltage selection section 12 are alternately outputted as V0 and V8. That is, when POL=0, VpA is outputted as V0, and VpB is outputted as V8. When POL=1, VpB is outputted as V0, and VpA is outputted as V8.

Figure 4:
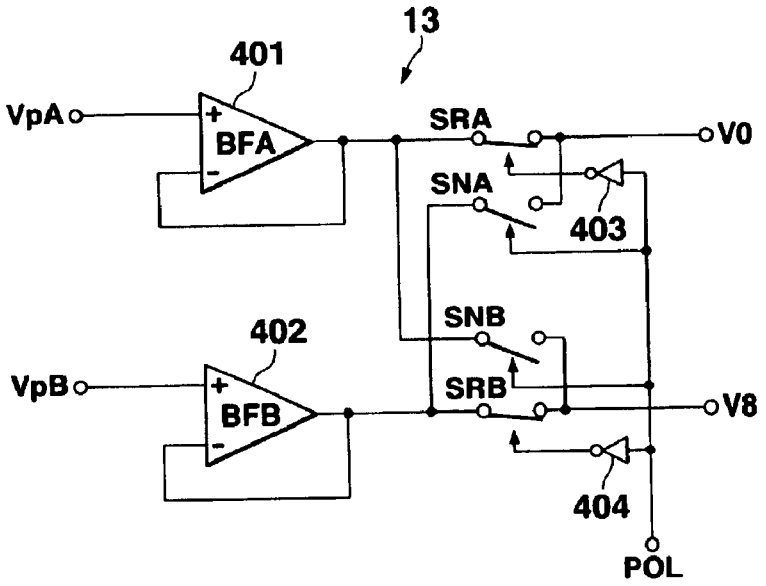
FIG. 4 is a circuit diagram showing one example of a concrete constitution of a reference voltage output section in the gradation reference voltage generation circuit according to the present invention.

One example of a concrete circuit constitution of the reference voltage output section 13 is shown in FIG. 4. The reference voltage output section 13 includes buffer circuits BFA401, BFB402, and switches SRA, SRB, SNA, SNB. The switches SNA, SNB are driven by the polarity reverse control signal POL, and the switches SRA, SRB are driven in response to the polarity reverse control signal POL via inverters 403, 404. Therefore, when POL=0, the switches SRA, SRB are turned on (connected). Moreover, SNA, SNB are turned off (disconnected), VpA is outputted as V0, and VpB is outputted as V8. On the other hand, when POL=1, the switches SRA, SRB are turned off (disconnected). Moreover, SNA, SNB are turned on (connected), VpB is outputted as V0, and VpA is outputted as V8.

Figure 5:
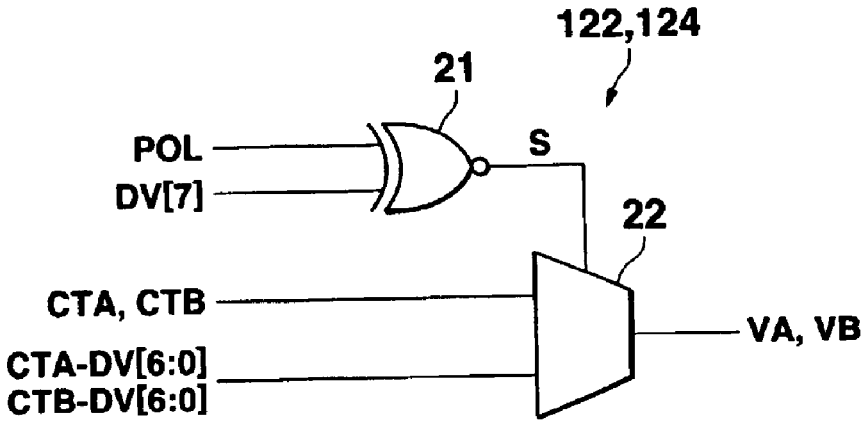
FIG. 5 is a circuit diagram showing parts of TGA, TGB in a first embodiment of a reference voltage selection section.

FIG. 5 is a circuit diagram showing parts of each of the TGA 122 and TGB 124 in the reference voltage selection section 12. Each of the TGA 122 and TGB 124 includes an exclusive OR 21 and multiplexer 22. The TGA 122 and TGB 124 have the same circuit constitution, and will both be described with reference to FIG. 5.

As shown in FIG. 5, the polarity reverse control signal POL and most significant bit DV[7] indicating the liquid crystal display mode in the correction signal DV[7:0] are inputted into the exclusive OR 21. A signal S as an output of the exclusive OR 21 is inputted as the selection signal into the multiplexer 22.

As the input signal of the multiplexer 22, the contrast setting signal CTA and a difference (CTA−DV[6:0]) between the contrast setting signal and ΔΔV correction voltage setting signal DV[6:0] are inputted into the TGA 122, and similarly CTB and (CTB−DV[6:0]) are inputted into the TGB 124.

Moreover, when the selection signal S is "1", the TGA 122 selects CTA, and the TGB 124 selects the signal CTB. When the selection signal S is "0", TGA 122 selects signal (CTA−DV[6:0]), and the TGB 124 selects (CTB−DV[6:0]).

Figure 6:
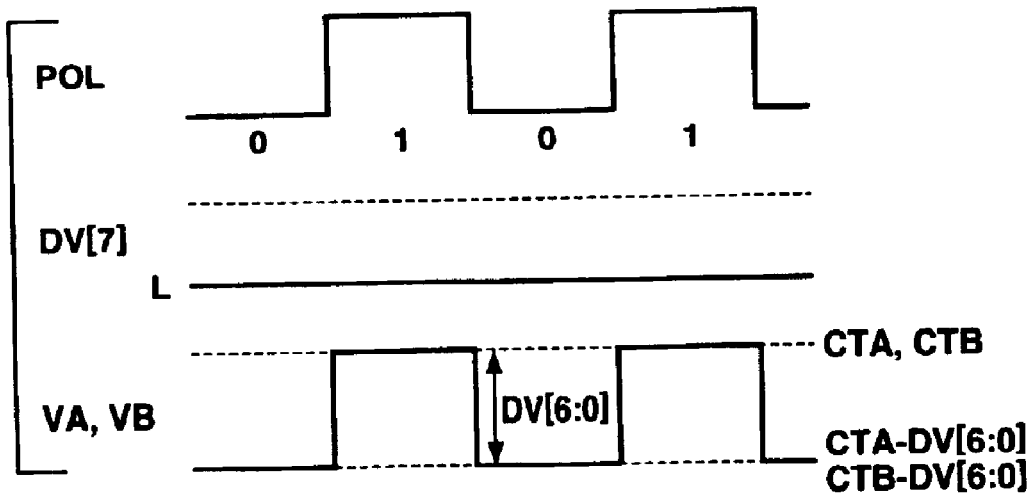
FIG. 6 is a timing chart illustrating operations of TGA, TGB in the first embodiment of the reference voltage selection section.

FIG. 6 is a timing chart showing operations of the TGA 122 and TGB 124 in the reference voltage selection section 12. Here, DV[7]=0, that is, the NW system will be described.

In this case, when POL=1, the selection signal S is "1". Thereby, as the signals VA and VB of the multiplexer 22, the TGA 122 outputs CTA, and the TGB 124 outputs CTB.

Moreover, when POL=0, the selection signal S is "0". Thereby, as VA and VB of the multiplexer 22, the TGA 122 outputs (CTA−DV[6:0]), and the TGB 124 outputs (CTB−DV[6:0]).

Thereby, a difference between the value of VA, VB for POL=1 and the value of VA, VB for POL=0 is DV[6:0]. Here, since the value of DV[6:0] is set to the value corresponding to ΔΔV as described above, the gradation reference voltage range is corrected by the value corresponding to ΔΔV as described hereinafter.

The present embodiment will next be described using equations.

Here, DV[7]=0, that is, the NW system will be described.

In the TGA 122 and TGB 124, the control values VA, VB outputted in response to the control signals are as follows from FIG. 6.

When $POL = 0$, $$\left.\begin{aligned} VA &= CTA - DV[6:0], \\ VB &= CTB - DV[6:0]. \end{aligned}\right\} \quad (2)$$

When $POL = 1$, $$\left.\begin{aligned} VA &= CTA, \\ VB &= CTB. \end{aligned}\right\} \quad (3)$$

These are outputted to the MXVA 121 and MXVB 123, respectively. Thereby, VpA, VpB outputted from the MXVA 121, MXVB 123 are as follows.

When $POL = 0$, $$\left.\begin{aligned} VpA &= Vc(VA) = Vc(CTA - DV[6:0]), \\ VpB &= Vc(255 - VB) \\ &= Vc(255 - (CTB - DV[6:0])). \end{aligned}\right\} \quad (4)$$

When $POL = 1$, $$\left.\begin{aligned} VpA &= Vc(VA) = Vc(CTA), \\ VpB &= Vc(255 - VB) \\ &= Vc(255 - CTB). \end{aligned}\right\} \quad (5)$$

These are outputted to the reference voltage output section 13.

Therefore, in the reference voltage output section 13:

when POL=0, VpA=V0, VpB=V8; and when POL=1, VpA=V8, VpB=V0, where V0=minimum gradation reference voltage=black gradation voltage, and V8=maximum gradation reference voltage=white gradation voltage.

Therefore, the following is outputted.

When $POL = 0$, $$\left.\begin{aligned} V0 &= VpA \\ &= Vc(CTA - DV[6:0]) < \text{black gradation voltage} > \\ V8 &= VpB \\ &= Vc(255 - (CTB - DV[6:0])) \\ &= Vc(255 - CTB + DV[6:0]) < \text{white gradation voltage} > \end{aligned}\right\} \quad (6)$$

When $POL = 1$, $$\left.\begin{aligned} V0 &= VpB \\ &= Vc(255 - CTB) < \text{black gradation voltage} > \\ V8 &= VpA \\ &= Vc(CTA) < \text{white gradation voltage} > \end{aligned}\right\} \quad (7)$$

Here, in the conventional driving, a waveform of a potential Vs of the data line DL for POL=0 is set to a reversed relation with a waveform of a potential Vs of the data line DL for POL=1. That is, the gradation reference voltage range is constant and set such that a reversed value of the gradation reference voltage during POL=0 corresponds to the gradation reference voltage during POL=1.

When POL=0, gradation reference voltages V0' and V8' are as follows.

$$\left.\begin{aligned} V0' &= Vc(CTA - DV[6:0]) \quad < \text{black gradation voltage} > \\ V8 &= Vc(255 - CTB) \quad < \text{white gradation voltage} > \end{aligned}\right\} \quad (8)$$

When POL=1, gradation reference voltages V0" and V8" are as follows.

$$\left.\begin{aligned} V0'' &= Vc(255 - CTB) \quad < \text{black gradation voltage} > \\ V8'' &= Vc(CTA - DV[6:0]) \quad < \text{white gradation voltage} > \end{aligned}\right\} \quad (9)$$

Then, V0'=V8", V8'=V0".

The present invention is compared with the above-described related art, that is, the equations (6) and (8), equations (7) and (9) are respectively compared with each other as follows.

When $POL = 0$, $$\left.\begin{aligned} V0 &= Vc(CTA - DV[6:0]) = V0 < \text{black gradation voltage} > \\ V8 &= Vc(255 - (CTB - DV[6:0])) \\ &= Vc(255 - CTB + DV[6:0]) \\ &= Vc(255 - CTB) + Vc(DV[6:0]) \\ &= V8' + Vc(DV[6:0]) < \text{white gradation voltage} > \end{aligned}\right\} \quad (10)$$

When $POL = 1$, $$\left.\begin{aligned} V0 &= Vc(255 - CTBD) = V0'' < \text{black gradation voltage} > \\ V8 &= Vc(CTA) \\ &= Vc(CTA - DV[6:0] + DV[6:0]) \\ &= Vc(CTA - DV[6:0]) + Vc(DV[6:0]) \\ &= V8'' + Vc(DV[6:0]) < \text{white gradation voltage} > \end{aligned}\right\} \quad (11)$$

It is seen that Vc(DV[6:0]) is added to the conventional white gradation voltages V8' and V8" in the white gradation voltage V8 of the equations (10) and (11).

Here, ΔΔV is a value obtained by subtracting the value of the field through voltage ΔV of the liquid crystal display pixel of a time at which the black gradation voltage V8 is applied to the liquid crystal display pixel from the value of the field through voltage ΔV of the liquid crystal display pixel of a time at which the white gradation voltage V8 is applied as described above. Therefore, in the present embodiment, DV[6:0] is set to a value corresponding to ΔΔV, that is, Vc(DV[6:0])=ΔΔV. As a result, every time the polarity reverse control signal POL is reversed, the white gradation voltage V8 is set to a value higher than the conventional value by ΔΔV. Thereby, when the gradation of the display data signal shifts to a white side from a black side, the gradation voltage corresponding to the gradation of the display data signal is corrected by a value corresponding to the change of ΔV. Thereby, every time the voltage $V_{LC}$ applied to the liquid crystal capacitance $C_{LC}$ is reversed, asymmetry is always inhibited regardless of the change of the display data signal.

Figure 7:
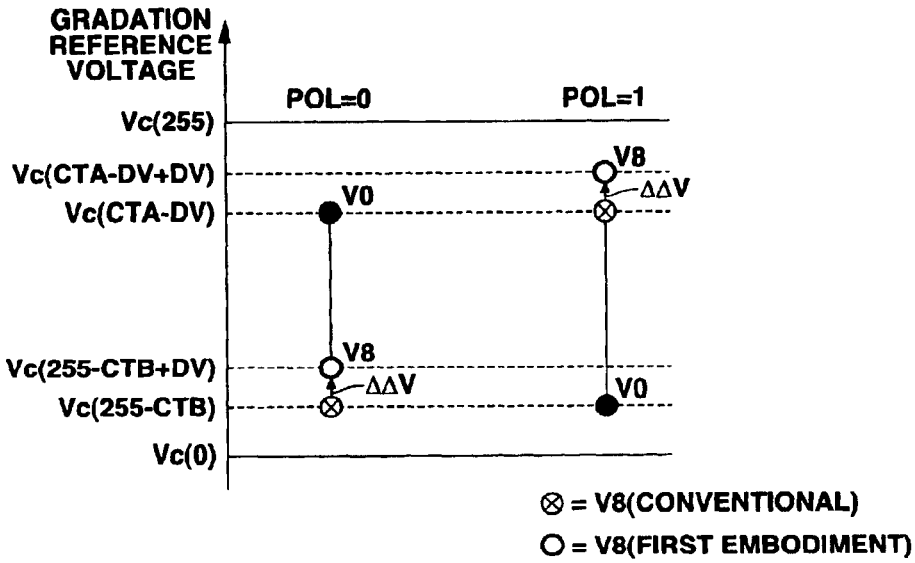
FIG. 7 is a diagram showing voltage values of black and white gradation voltages in the first embodiment in comparison with conventional values.

FIG. 7 is a diagram showing the voltage values of the black and white gradation voltages V0 and V8 of the times at which POL=0 and POL=1 in comparison with the conventional values.

As shown in FIG. 7, when POL=0, the conventional value of V8 is Vc(255−CTB). On the other hand, in the present embodiment, the value rises by ΔΔV to Vc(255−CTB+DV[6:0]).

Moreover, when POL=1, the conventional value of V8 is Vc(CTA−DV[6:0]). On the other hand, in the present embodiment, the value rises by ΔΔV to Vc(CTA−DV[6:0]+DV[6:0]).

Thereby, the gradation reference voltage range is always corrected regardless of the change of the display data signal. Every time the voltage $V_{LC}$ applied to the liquid crystal capacitance $C_{LC}$ is reversed, the voltage is inhibited from becoming asymmetric. Therefore, the flicker and seizing are inhibited from occurring, a high-quality display can be realized, the liquid crystal device is inhibited from being deteriorated, and the reliability of the liquid crystal can be enhanced.

Here, the correction voltage setting signal DV[6:0] in the present embodiment indicates a value inputted from the outside. Therefore, the value of the correction voltage setting signal DV[6:0] can appropriately be set if necessary. Therefore, for example, even when the liquid crystal material to be used is changed, or the specifications of the liquid crystal display panel change, an appropriate value can be inputted. As a result, even when the liquid crystal material is changed, or the specifications of the liquid crystal display panel change, an optimum gradation voltage can always be set without changing the driving circuit, the flicker or seizing is inhibited from occurring, and the display quality can be enhanced.

In the conventional art, as described above, due to the influence of ΔΔV by which ΔV changes with the applied voltage $V_{LC}$, for the voltage $V_{LC}$ applied to the liquid crystal capacitance $C_{LC}$, to inhibit a difference from being generated in the positive and negative charge amounts held by the liquid crystal capacitance $C_{LC}$ by the change of the display data signal, the auxiliary capacitance Cs is set to be relatively large, and the value of the field through voltage ΔV is reduced. However, according to the constitution of the present embodiment, since the gradation reference voltage range is always corrected in accordance with the value of ΔΔV, it is unnecessary to reduce the value of the field through voltage ΔV different from the conventional art. Therefore, it is unnecessary to increase the auxiliary capacitance Cs as in the conventional art. That is, the magnitude of the auxiliary capacitance Cs may be minimum as long as it is sufficient for holding the driving voltage, and can be reduced as compared with the conventional capacitance. Therefore, an open area ratio can be increased as compared with the conventional art, and the display quality can further be enhanced. Moreover, with the increase of the open area ratio, the luminance of the backlight can be reduced, and an effect of reduction of power consumption can be obtained.

Additionally, the NW system has been described above with DV[7]=0, but the present invention is not limited to this system, and may be applied to the NB system in which DV[7]=1 is assumed. In this case, the correspondence of VA, VB with respect to the reverse control signal POL is reversed. Thereby, the black gradation voltage V0 is corrected in accordance with ΔΔV similarly as described above, the flicker or seizing is inhibited from occurring, the high-quality display can be realized, the liquid crystal device is inhibited from being deteriorated, and the reliability of the liquid crystal can be enhanced.

<Second Embodiment>

A second embodiment of the display driving apparatus according to the present invention will next be described with reference to FIGS. 8A to 10. The second embodiment is different from the first embodiment in that the amplitude (dynamic range) of the voltage supplied to the data line DL is increased in accordance with the display data signal.

The voltage $V_{LC}$ applied to the liquid crystal capacitance $C_{LC}$ is a voltage of a difference between the potential $V_{COM}$ applied to the common electrode VCOM and the potential Vs of the data line DL. Therefore, when the same voltage $V_{LC}$ is applied to the liquid crystal capacitance $C_{LC}$, according to the second embodiment, the amplitude of the potential Vs of the data line DL is increased. This can reduce the amplitude of the voltage $V_{COM}$ applied to the common electrode VCOM. Here, since the opposed electrode is connected to the common electrode VCOM, and a relatively large capacitance of all pixels is a load, a high power is required for driving the electrode.

To solve the problem, according to the second embodiment, the amplitude of the voltage $V_{COM}$ applied to the common electrode VCOM can be reduced, therefore the power required for driving the common electrode VCOM can be reduced, and the power consumption of the display driving apparatus can be greatly reduced.

Since the constitution of the display apparatus with the display driving apparatus of the present embodiment applied thereto is the same as that of FIG. 1, the description of a block diagram is omitted.

Here, the second embodiment is different from the first embodiment in the setting method of the gradation reference voltage in the constitution of the gradation reference voltage generation circuit 200, and in the constitutions of the TGA 122 and TGB 124 in the gradation reference voltage generation circuit 200.

The circuit constitution and operation of the TGA 122, TGB 124 in the second embodiment will be described hereinafter.

Figure 8A:
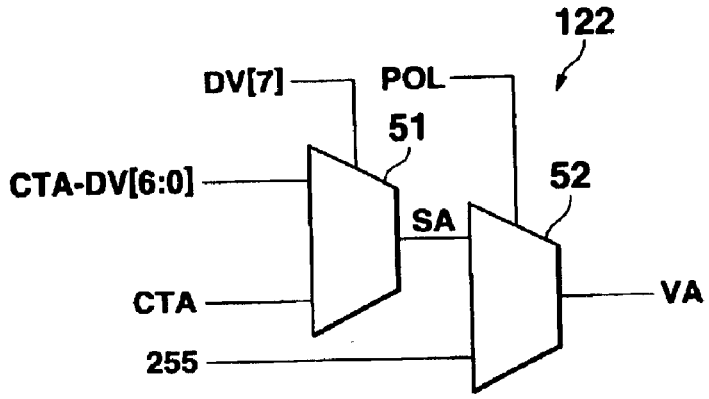
FIGS. 8A and 8B are circuit diagrams showing parts of TGA, TGB in a second embodiment of the reference voltage selection section.
Figure 8B:
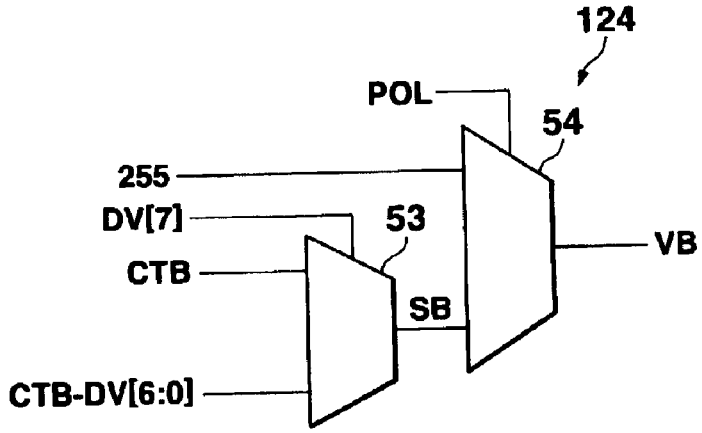

FIG. 8A shows the TGA 122, and FIG. 8B shows the TGB 124. That is, the TGA 122 includes multiplexers 51, 52, and the TGB 124 includes multiplexers 53, 54.

As shown in FIG. 8A, in the TGA 122, to the multiplexer 51, the contrast setting signal CTA, and the difference (CTA−DV[6:0]) between the contrast setting signal CTA and ΔΔV correction voltage setting signal DV[6:0] are inputted, and the most significant bit DV[7] indicating the liquid crystal display mode in the correction signal DV[7:0] is inputted as the selection signal. In accordance with the level of DV[7], either signal CTA or (CTA−DV[6:0]) is selected and outputted as a signal SA.

Here, similarly as described above, as the liquid crystal display mode, DV[7] is set to "0" in the normally white system (NW system), and DV[7] is set to "1" in the normally black system (NB system).

Therefore, as the signal SA, (CTA−DV[6:0]) is outputted during DV[7]=0, that is, in the NW system, and CTA is outputted during DV[7]=1, that is, in the NB system.

To the multiplexer 52, the signal SA, and a hexadecimal numeral "FF" (255) are inputted, and the polarity reverse control signal POL of the common electrode potential $V_{COM}$ is inputted as the selection signal. In accordance with the level of POL, either the signal SA or the signal of the hexadecimal numeral "FF" is selected and outputted as a signal VA.

That is, the signal SA is outputted as VpA during POL=0, that is, in the NW system, and the hexadecimal numeral "FF" is outputted as VA during POL=1, that is, in the NB system.

As shown in FIG. 8B, in the TGB 124, to the multiplexer 53, the contrast setting signal CTB, and the difference (CTB−DV[6:0]) between the contrast setting signal CTB and ΔΔV correction voltage setting signal DV[6:0] are inputted, and DV[7] indicating the liquid crystal display mode is inputted as the selection signal. In accordance with the level of DV[7], either one signal CTB or (CTB−DV [6:0]) is outputted as a signal SB.

That is, as the signal SB, the signal CTB is outputted during DV[7]=0, that is, in the NW system, and (CTB−DV [6:0]) is outputted during DV[7]=1, that is, in the NB system.

To the multiplexer 54, the hexadecimal numeral "FF" (255), and the signal SB are inputted, and the polarity reverse control signal POL is inputted as the selection signal. In accordance with the level of POL, either the signal of the hexadecimal numeral "FF" or the signal SB is selected and outputted as a control value VB.

That is, the hexadecimal numeral "FF" is outputted as VB during POL=0, that is, in the NW system, and the signal SB is outputted as VB during POL=1, that is, in the NB system.

Figure 9:
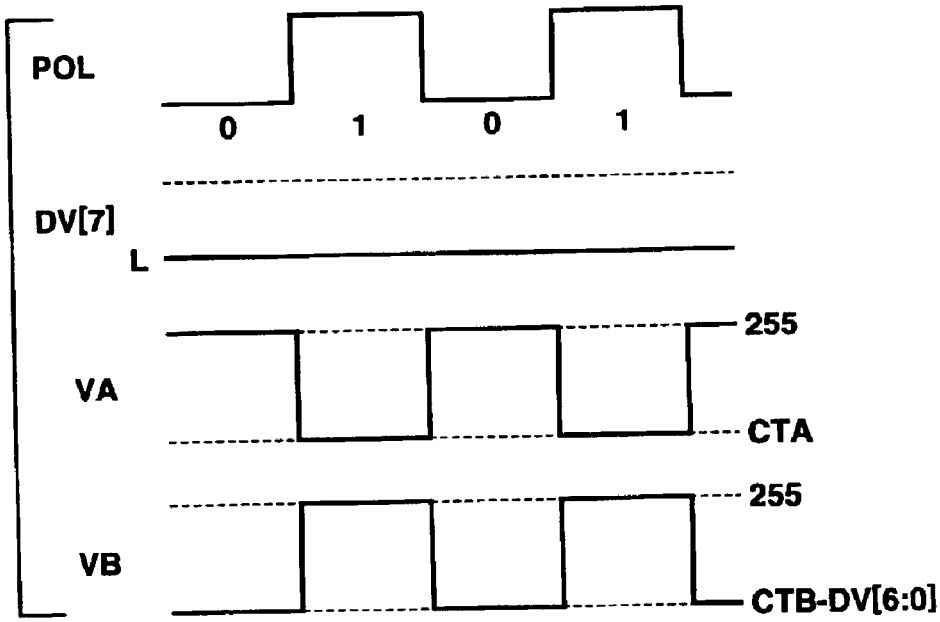
FIG. 9 is a timing chart illustrating operations of TGA, TGB in the second embodiment of the reference voltage selection section.

FIG. 9 is a timing chart showing the operation of the circuit of the TGA 122 and TGB 124 in the second embodiment. Here, DV[7]=0, that is, the NW system will be described.

In this case, according to the above-described constitution, when POL=1, the control value VA outputted from the TGA 122 is CTA, and the control value VB outputted from the TGB 124 is the hexadecimal numeral "FF".

Moreover, when POL=0, the control value VA outputted from the TGA 122 is the hexadecimal numeral "FF", and the control value VB outputted from the TGB 124 is (CTB−DV[6:0]).

The reference voltage selection section 12 of FIG. 2 to which the circuits of the TGA 122 and TGB 124 of FIGS. 8A, 8B are applied will next be described using equations.

Here, DV[7]=0, that is, the NW system will be described.

The gradation voltages V0 and V8 outputted from the reference voltage output section 13 are as follows.

When $POL = 0$, $$\left.\begin{aligned} V0 &= Vc(VA) = Vc(255) < \text{black gradation voltage} > \\ V8 &= Vc(255 - VB) \\ &= Vc(255 - (CTB - DV[6:0])) \\ &= Vc(255 - CTB + DV[6:0]) < \text{white gradation voltage} > \end{aligned}\right\} \quad (12)$$

When $POL = 1$, $$\left.\begin{aligned} V0 &= Vc(255 - VB) \\ &= Vc(0) < \text{black gradation voltage} > \\ V8 &= Vc(VA) \\ &= Vc(CTA) \\ &= Vc(CTA - DV[6:0] + DV[6:0]) \\ &\quad < \text{white gradation voltage} > \end{aligned}\right\} \quad (13)$$

Thereby, When POL=0 and POL=1, the white gradation voltage V8 is the same as that of the first embodiment. Therefore, as described above, this value is obtained after correcting ΔΔV, and an effect similar to that of the first embodiment can be obtained.

On the other hand, the black gradation voltage V0 indicates Vc(255) (maximum value) during POL=0, that is, in the NW system, and indicates Vc(0) (minimum value) during POL=1, that is, in the NB system.

Figure 10:
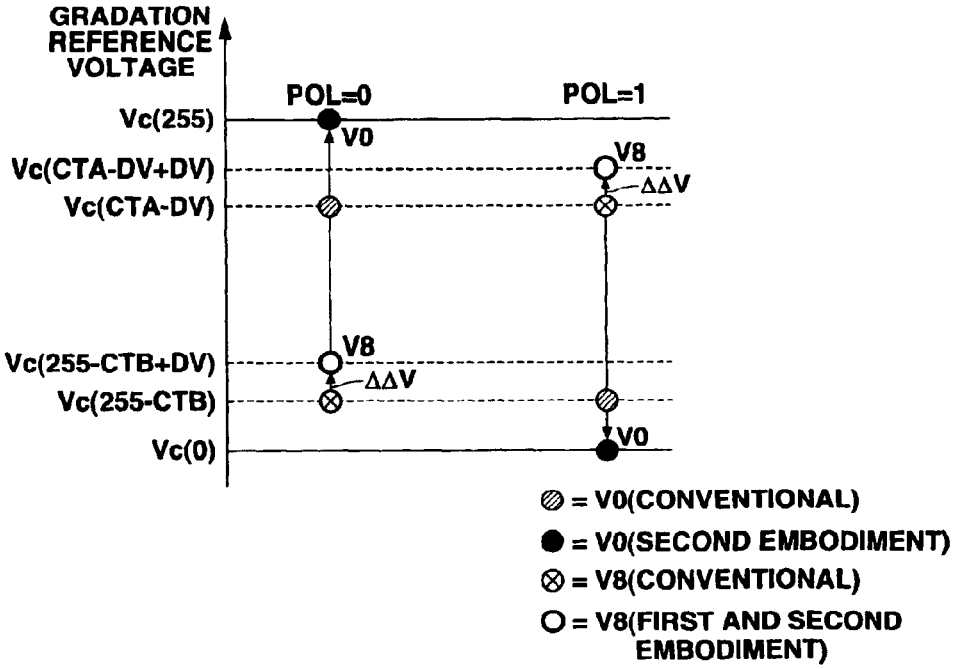
FIG. 10 is a diagram showing voltage values of the black and white gradation voltages in the second embodiment in comparison with the conventional values.

FIG. 10 is a diagram showing the voltage values of the black and white gradation voltages V0 and V8 during POL=0 and POL=1 in comparison with the conventional values.

As shown in FIG. 10, when POL=0, the conventional value of the black gradation voltage V0 is Vc(CTA−DV [6:0]). On the other hand, in the second embodiment, the value is Vc(255).

Moreover, when POL=1, the conventional value of the black gradation voltage V0 is Vc(255−CTB). In the second embodiment, the value is Vc(0).

That is, the gradation voltage range is set to be larger than that of the conventional art. Accordingly, the amplitude of the potential Vs applied to the data line DL increases.

Thereby, when the voltage $V_{LC}$ applied to the liquid crystal capacitance $C_{LC}$ is set to be the same as the conventional voltage, the amplitude of the potential $V_{COM}$ applied to the common electrode VCOM can be reduced. The amplitude reduction amount of the potential $V_{COM}$ applied to the common electrode VCOM is proportional to the amplitude increase amount of V0. Thereby, since the voltage amplitude of the potential $V_{COM}$ can be reduced, the power consumption required for driving the common electrode VCOM can be reduced, and the power consumption of the display driving apparatus can largely be reduced.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A display driving apparatus which drives an active matrix liquid crystal display panel including a plurality of liquid crystal display pixels, comprising:

a common electrode reverse section for reversing a potential of a common electrode of the active matrix liquid crystal display panel for each predetermined period; and a gradation reference voltage setting section for setting minimum and maximum gradation reference voltages based on a contrast set value and correction voltage set value, every time the common electrode reverse section reverses the potential of the common electrode and for setting one of fluctuation center voltages of the minimum and maximum gradation reference voltages for each reverse of the common electrode potential, by which a smaller voltage is applied to the liquid crystal display pixels, such that the one voltage is higher than the other voltage by a voltage corresponding to the correction voltage set value.

2. The display driving apparatus according to claim 1, wherein the voltage corresponding to the correction voltage set value in the gradation reference voltage setting section has a voltage value of a difference between a value of a field through voltage in the liquid crystal display pixels obtained when one of the minimum and maximum gradation reference voltages is applied to the liquid crystal display pixels in the active matrix liquid crystal display panel, and a value of a field through voltage in the liquid crystal display pixels obtained when the other voltage is applied.

3. The display driving apparatus according to claim 1, wherein the gradation reference voltage setting section includes:

reference voltage selection means including:

a γ reference voltage generation section for generating voltages of a plurality of stages, first voltage selection means for selecting and outputting a first voltage of a stage corresponding to a first value based on the contrast set value and correction voltage set value from the voltages of the plurality of stages generated by the γ reference voltage generation section, every time the potential of the common electrode is reversed, and second voltage selection means for selecting and outputting a second voltage of a stage corresponding to a value obtained by subtracting a second value based on the contrast set value and correction voltage set value from a maximum value of the number of stages from the voltages of the plurality of stages generated by the γ reference voltage generation section, every time the potential of the common electrode is reversed; and a reference voltage output section for alternately outputting the first and second voltages outputted from the reference voltage selection means as the minimum and maximum gradation reference voltages, every time the potential of the common electrode is reversed.

4. The display driving apparatus according to claim 3, wherein the first and second values based on the contrast set value and correction voltage set value in the first and second voltage selection means of the reference voltage selection means are any one of a value by the contrast set value and a value obtained by subtracting the value by the correction voltage set value from the value by the contrast set value, and are alternately set, every time the common electrode potential is reversed.

5. The display driving apparatus according to claim 3, wherein the first and second values based on the contrast set value and correction voltage set value in the first and second voltage selection means of the reference voltage selection means are any pair of values of a maximum value of the stage number in the γ reference voltage generation section and a value obtained by subtracting the value by the correction voltage set value from the value by the contrast set value, and the value by the contrast set value and the maximum value of the stage number in the γ reference voltage generation section, and are alternately set, every time the common electrode potential is reversed.

6. A display apparatus comprising:

an active matrix liquid crystal display panel including a plurality of pixel electrodes arranged in a matrix form, a common electrode disposed opposite to the pixel electrodes, and a plurality of liquid crystal display pixels including liquid crystals held between the pixel electrodes and common electrode;

a common electrode reverse section for reversing a potential of the common electrode of the active matrix liquid crystal display panel for each predetermined period; and a gradation reference voltage setting section for setting minimum and maximum gradation reference voltages based on a contrast set value and correction voltage set value, every time the common electrode reverse section means reverses the common electrode potential and for setting one of fluctuation center voltages of the minimum and maximum gradation reference voltages for each reverse of the common electrode potential, by which a smaller voltage is applied to the liquid crystal display pixels, such that the one voltage is higher than the other voltage by a voltage corresponding to the correction voltage set value.

7. The display apparatus according to claim 6, wherein the voltage corresponding to the correction voltage set value in the gradation reference voltage setting section has a voltage value of a difference between a value of a field through voltage in the liquid crystal display pixels obtained when one of the minimum and maximum gradation reference voltages is applied to the liquid crystal display pixels, and a value of a field through voltage in the liquid crystal display pixels obtained when the other voltage is applied.

8. The display apparatus according to claim 6, wherein the gradation reference voltage setting section includes:

reference voltage selection means including:

a γ reference voltage generation section for generating voltages of a plurality of stages, first voltage selection means for selecting and outputting a first voltage of a stage corresponding to a first value based on the contrast set value and correction voltage set value from the voltages of the plurality of stages generated by the γ reference voltage generation section, every time the potential of the common electrode is reversed, and second voltage selection means for selecting and outputting a second voltage of a stage corresponding to a value obtained by subtracting a second value based on the contrast set value and correction voltage set value from a maximum value of the number of stages from the voltages of the plurality of stages generated by the γ reference voltage generation section, every time the potential of the common electrode is reversed; and reference voltage output section for alternately outputting the first and second voltages outputted from the reference voltage selection means as the minimum and maximum gradation reference voltages, every time the potential of the common electrode is reversed.

9. The display apparatus according to claim 8, wherein the first and second values based on the contrast set value and correction voltage set value in the first and second voltage selection means of the reference voltage selection means are any one of a value by the contrast set value and a value obtained by subtracting a value by the correction voltage set value from the value by the contrast set value, and are alternately set, every time the common electrode potential is reversed.

10. The display apparatus according to claim 8, wherein the first and second values based on the contrast set value and correction voltage set value in the first and second voltage selection means of the reference voltage selection means are any pair of values of a maximum value of the number of stages in the γ reference voltage generation section and the value obtained by subtracting the value by the correction voltage set value from the value by the contrast set value, and the value by the contrast set value and the maximum value of the stage number in the γ reference voltage generation section, and are alternately set, every time the common electrode potential is reversed.

11. The display apparatus according to claim 8, wherein the reference voltage selection means reverses correspondence of the first and second values based on the contrast set value and correction voltage set value with respect to polarity reverse of the common electrode potential in the first and second voltage selection means depending on whether the active matrix liquid crystal display panel is of a normally white system or a normally black system.

12. A driving control method of a display driving apparatus which drives an active matrix liquid crystal display panel including a plurality of liquid crystal display pixels, the method comprising:

reversing/driving a potential of a common electrode of the active matrix liquid crystal display panel for each predetermined period;

setting minimum and maximum gradation reference voltages based on a contrast set value and correction voltage set value, every time the common electrode potential is reversed; and setting one of fluctuation center voltages of the respective gradation reference voltages for each reverse of the common electrode potential, by which a smaller voltage is applied to the liquid crystal display pixels, such that the one voltage is higher than the other voltage by a voltage corresponding to the correction voltage set value.

13. The driving control method according to claim 12, wherein the voltage corresponding to the correction voltage set value has a voltage value of a difference between a value of a field through voltage in the liquid crystal display pixels obtained when one of the minimum and maximum gradation reference voltages is applied to the liquid crystal display pixels in the active matrix liquid crystal display panel, and a value of a field through voltage in the liquid crystal display pixels obtained when the other voltage is applied.

14. The driving control method according to claim 12, wherein the setting of the minimum and maximum gradation reference voltages based on the contrast set value and correction voltage set value includes:

generating gradation voltages of a plurality of stages;

selecting and outputting a first voltage of a stage corresponding to a first value based on the contrast set value and correction voltage set value, and a second voltage of a stage corresponding to a value obtained by subtracting a second value based on the contrast set value and correction voltage set value from a maximum value of the number of stages from the gradation voltages of the plurality of stages, every time the potential of the common electrode is reversed; and alternately setting the first and second voltages as the minimum and maximum gradation reference voltages, every time the potential of the common electrode is reversed.

15. The driving control method according to claim 14, further comprising:

setting the first and second values based on the contrast set value and correction voltage set value as any one of a value by the contrast set value and a value obtained by subtracting a value by the correction voltage set value from the value by the contrast set value; and alternately setting the first and second values, every time the common electrode potential is reversed.

16. The driving control method according to claim 14, further comprising:

setting the first and second values based on the contrast set value and correction voltage set value as any pair of values of:

a maximum value of the number of stages of the gradation voltages and the value obtained by subtracting the value by the correction voltage set value from the value by the contrast set value; and the value by the contrast set value and the maximum value of the stage number of the gradation voltages; and alternately setting the first and second values, every time the common electrode potential is reversed.

17. The driving control method according to claim 14, further comprising: reversing correspondence of the first and second values based on the contrast set value and correction voltage set value for each polarity reverse of the common electrode potential depending on whether the active matrix liquid crystal display panel is of a normally white system or a normally black system.

* * * * *